US008721371B2

(12) United States Patent
Picker et al.

(10) Patent No.: US 8,721,371 B2
(45) Date of Patent: May 13, 2014

(54) CONDUIT ADAPTOR

(75) Inventors: Benjamin Paul Picker, Tipp City, OH (US); Kenneth Ray Barnett, Springfield, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 36 days.

(21) Appl. No.: 13/478,235

(22) Filed: May 23, 2012

(65) Prior Publication Data

US 2012/0302100 A1 Nov. 29, 2012

Related U.S. Application Data

(60) Provisional application No. 61/490,947, filed on May 27, 2011.

(51) Int. Cl.
*H01R 24/00* (2011.01)

(52) U.S. Cl.
USPC ..... 439/685; 429/468; 429/694; 429/367

(58) Field of Classification Search
USPC ..... 439/685, 694, 468, 367, 466, 902
See application file for complete search history.

(56) References Cited

U.S. PATENT DOCUMENTS 4,109,992 A * 8/1978 Hughes et al. ..... 439/620.21
5,336,105 A 8/1994 Wisner
5,911,595 A * 6/1999 Orr et al. ..... 439/471
6,916,210 B2 7/2005 Moore, Jr. et al.
7,762,685 B1 * 7/2010 Beucler ..... 362/267
8,007,307 B2 * 8/2011 Wang ..... 439/367
8,113,890 B2 * 2/2012 Duesterhoeft ..... 439/855
2008/0023075 A1 * 1/2008 Bravo et al. ..... 137/312
2010/0196175 A1 8/2010 Bedell et al.

FOREIGN PATENT DOCUMENTS

WO WO-2010111492 A2 9/2010

OTHER PUBLICATIONS

International Search Report regarding Application No. PCT/US2012/039274, mailed Nov. 28, 2012.
Written Opinion of the International Searching Authority regarding Application No. PCT/US2012/039274, mailed Nov. 28, 2012.

* cited by examiner

*Primary Examiner* — Hien Vu
(74) *Attorney, Agent, or Firm* — Harness, Dickey & Pierce, P.L.C.

(57) ABSTRACT

An adaptor may include a body portion and a conduit receptacle. The body portion may include a cross-member and first and second arms extending from the cross-member. The first and second arms may include first and second engagement features, respectively. The conduit receptacle may extend from the cross-member in a direction opposite the first and second arms and may include an aperture and a third engagement feature. The third engagement feature may retain an outer surface of a conduit. The conduit may receive and protect a plurality of wires transmitting electrical power to an electrically powered component.

14 Claims, 5 Drawing Sheets

CONDUIT ADAPTOR

CROSS-REFERENCE TO RELATED APPLICATIONS

This application claims the benefit of U.S. Provisional Application No. 61/490,947, filed on May 27, 2011. The entire disclosure of the above application is incorporated herein by reference.

FIELD

The present disclosure relates to an electrical-plug assembly and an adaptor for connecting a conduit to the plug assembly.

BACKGROUND

This section provides background information related to the present disclosure and is not necessarily prior art.

Electrically powered components may include at least one terminal assembly for electrically coupling the component to an external source of electrical power. A plug assembly may engage the terminal assembly to electrically couple a plurality of wires communicating with the source of electrical power to the terminal assembly to selectively supply the component with electrical power.

SUMMARY

This section provides a general summary of the disclosure, and is not a comprehensive disclosure of its full scope or all of its features.

In one form, the present disclosure provides an adaptor that may include a body portion and a conduit receptacle. The body portion may include a cross-member and first and second arms extending from the cross-member. The first and second arms may include first and second engagement features, respectively. The conduit receptacle may extend from the cross-member in a direction opposite the first and second arms and may include an aperture and a third engagement feature. The third engagement feature may retain an outer surface of a conduit.

In some embodiments, the electrical receptacles in the plug body may receive a respective one of a plurality of conductor pins extending from an electrical terminal to provide electrical communication between the plurality of wires and the plurality of conductor pins.

In some embodiments, the conduit receptacle may include a protrusion extending radially inward from a surface defining the aperture. The protrusion could engage a helical surface of the conduit.

In some embodiments, the adaptor may include a cross-member and first and second arms extending from the cross-member. The conduit receptacle may extend from the cross-member in a direction opposite the first and second arms. The plug body may be received between the first and second arms.

In some embodiments, a plug retainer may engage the plug body and may include a plurality of tabs configured to engage a fence at least partially surrounding an electrical terminal of a compressor. The first and second arms may include first and second tabs, respectively, that engage the plug retainer. The plug retainer may include first and second members receiving the plug body therebetween. The first and second members may be received between the first and second arms of the adaptor.

In another form, the present disclosure provides an assembly that may include a plug body, an adaptor, and a conduit. The plug body may encase a plurality of electrical receptacles and first ends of a plurality of wires electrically connected to the electrical receptacles. The adaptor may be coupled to the plug body and may include a conduit receptacle having an aperture. The conduit may engage the aperture to allow the plurality of wires to extend through the aperture and through the conduit.

In some embodiments, the first and second arms may include generally U-shaped cross sections. The first and second arms and the conduit receptacle may be integrally formed with each other.

In some embodiments, the third engagement feature may include a helical protrusion extending into the aperture.

In some embodiments, the first and second arms may be resiliently flexible to allow a terminal plug retainer to snap into engagement with the first and second engagement features.

In some embodiments, a terminal plug assembly may be received between the first and second arms. Wires connected to the terminal plug assembly may extend through the conduit receptacle and into the conduit. The terminal plug assembly may receive conductor pins extending from an electrical terminal of a compressor.

As an example, the present disclosure provides a compressor that may include a shell, an electrical terminal, a plug, a plurality of wires, a plug retainer, an adaptor and a conduit. The electrical terminal may engage an opening in the shell and may include a fence at least partially surrounding a plurality of first electrically conductive members. The plug may include a plurality of second electrically conductive members in electrical communication with the first electrically conductive members. The plurality of wires may extend from the second electrically conductive members. The plug retainer may include a body portion and first, second and third members extending from the body portion and engaging the fence. The first and second members may receive a portion of the plug. The adaptor may include a cross-member, first and second arms extending from the cross-member in a first direction, and a conduit receptacle extending from the cross-member in a second direction. The plug may be disposed between the first and second arms. The first and second members of the plug retainer may engage the first and second arms. The conduit may engage the conduit receptacle and receive the plurality of wires.

In some embodiments, the conduit receptacle may include an aperture and a protrusion extending into the aperture and engaging an outer surface of the conduit.

In some embodiments, the first and second arms may include first and second tabs, respectively, that extend toward each other and engage the first and second members, respectively. The first and second arms may be resiliently flexible to allow the first and second members to snap into engagement with the first and second tabs.

In some embodiments, the first and second members may be disposed between the first and second arms.

In some embodiments, the plug retainer may support a majority of a load of the adaptor and the conduit.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
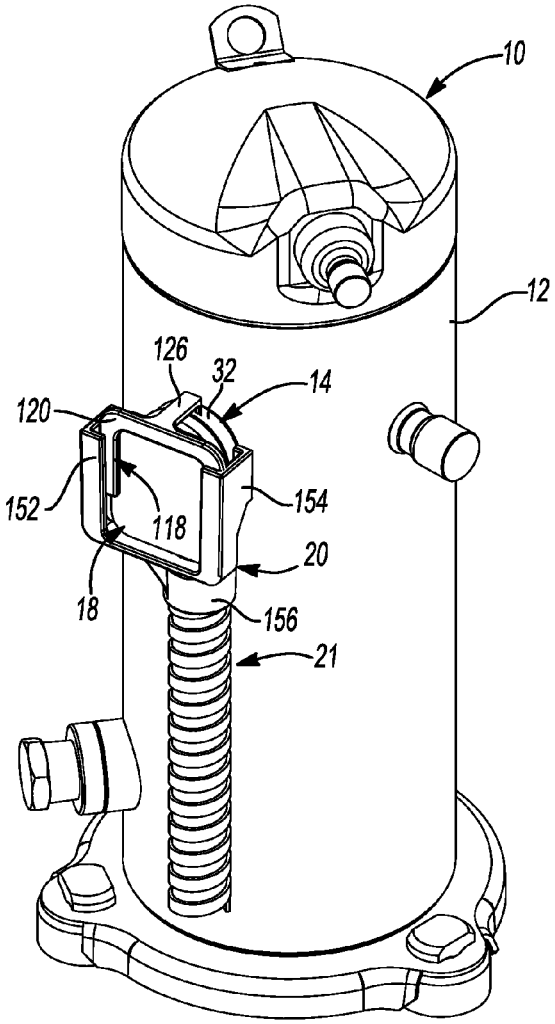
FIG. 1 is a perspective view of a compressor having a plug assembly and conduit adaptor connected thereto.
Figure 2:
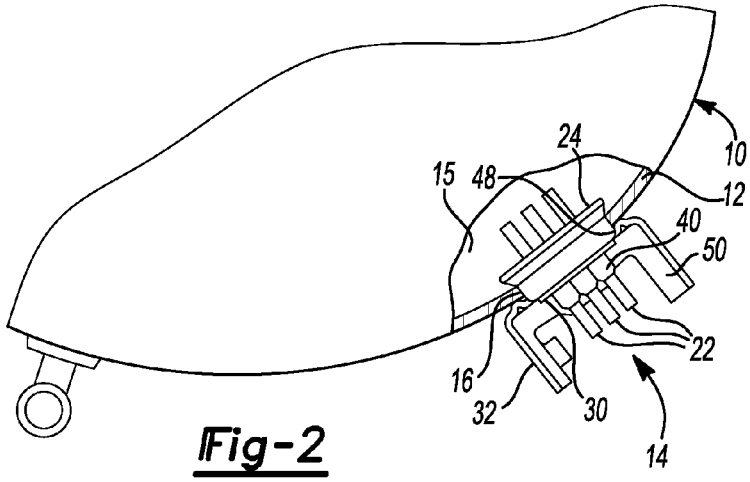
FIG. 2 is a partial cross-sectional view of a terminal of the compressor.
Figure 3:
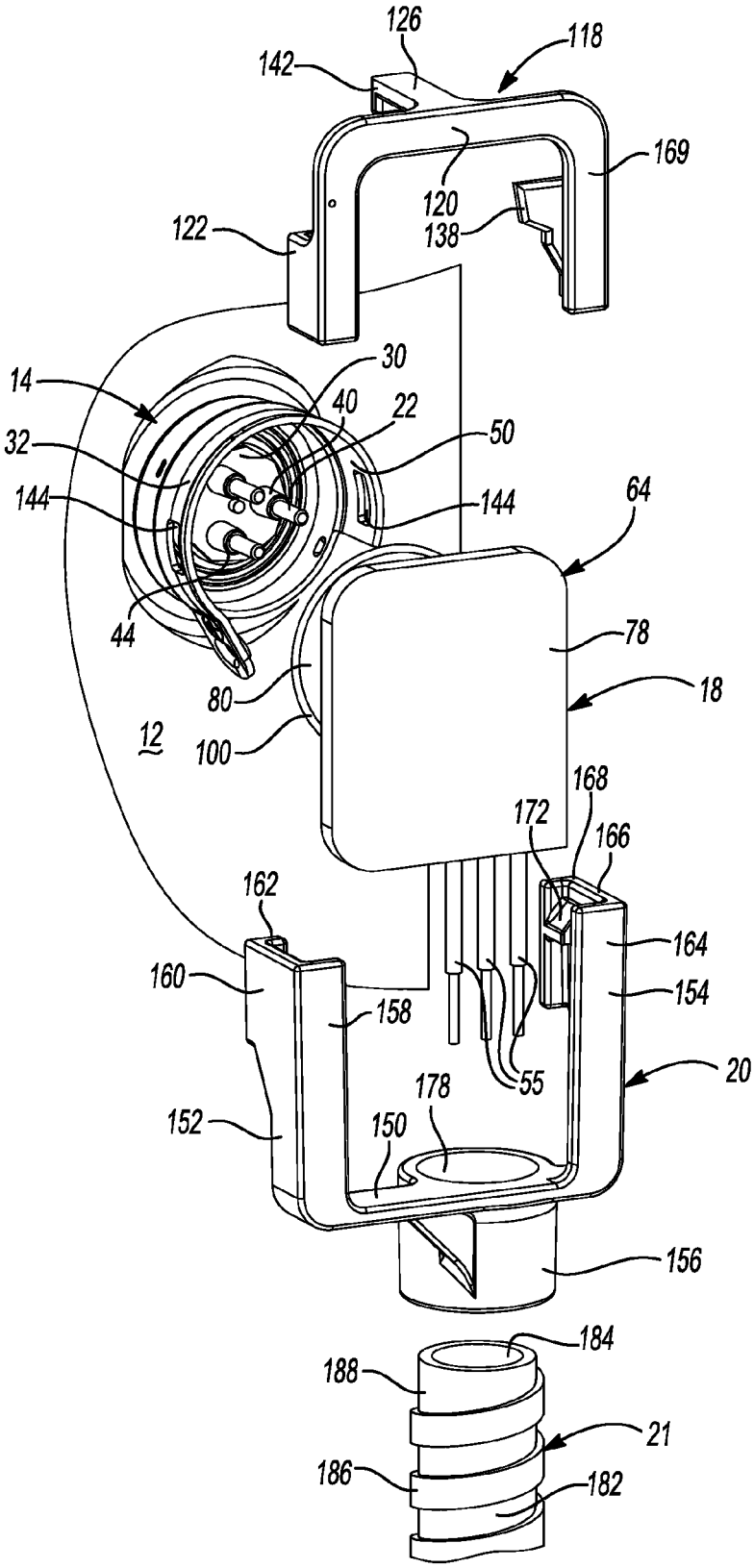
FIG. 3 is a partially exploded perspective view of the terminal, the plug assembly and the conduit adaptor.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIGS. 1-7, a conduit adaptor 20 is provided that may couple a conduit 21 to a plug assembly 18. The plug assembly 18 may electrically couple an electrical terminal 14 to a source of electrical power (not shown). The terminal 14 may be electrically connected to a load such as a motor (not shown) of an electrically powered component or module, such as a compressor 10, for example, or any other electrically powered component or module including a control and/or diagnostic module, a circuit board, a fan, a heater or a sensor.

The terminal 14 is electrically coupled to an exemplary load, which will be described in the context of the compressor 10 depicted in FIG. 1, with the understanding that this is an example and that the conduit adaptor 20 may be used with any other load. The compressor 10 may be a scroll compressor, a linear compressor, a screw compressor, a centrifugal compressor, or a reciprocating compressor, for example, or any other type of compressor.

The compressor 10 may compress a refrigerant or other working fluid and circulate the working fluid throughout a cooling system or heat pump system, for example. The compressor 10 may include a shell 12 defining a sealed chamber 15 within which the motor and a compression mechanism (not shown) may be disposed. The terminal 14 may be sealingly disposed within an aperture 16 that extends through the shell 12. The sealed relationship between the terminal 14 and the shell 12 maintains the integrity of the sealed chamber 15 and may provide the chamber 15 with a hermetic seal. The terminal 14 may provide for the electrical connection between an external source of electrical power (not shown) and the motor disposed within the chamber 15.

The terminal 14 may include a plurality of conductor pins 22, a terminal body 24, a plurality of fused-glass and/or ceramic insulators (not specifically shown), a silicone-rubber molding 30, and a fence 32. The terminal body 24 may be a cup-shaped metallic member that may be sealingly disposed within the aperture 16 by resistance welding and/or any other suitable attachment method. Each of a plurality of apertures (not shown) extending through the terminal body 24 may sealingly receive a respective one of the plurality of fused-glass insulators and a respective one of the plurality of conductor pins 22. Each conductor pin 22 may extend through a respective fused-glass insulator to provide electrical communication between an exterior and interior of the shell 12.

Each of the ceramic insulators may be secured to a respective one of the plurality of conductor pins 22 that extends into the chamber 15. The ceramic insulators may insulate the conductor pins 22 from contact with the terminal body 24 as well as provide insulation between adjacent conductor pins 22. The silicone-rubber molding 30 may be located on an outside of the terminal body 24 and may include a plurality of upstanding jackets 40 extending therefrom. Each of the upstanding jackets 40 may include an aperture 44 extending through the silicone-rubber molding 30 and may receive a respective one of the conductor pins 22. The relationship between the apertures 44 and the conductor pins 22 may serve to both seal and provide insulation for the conductor pins 22.

The fence 32 may be physically secured to the outside of the shell 12 by resistance welding and/or any other suitable attachment method. In this regard, the terminal body 24 and the fence 32 may be simultaneously or sequentially welded to the shell 12 to provide a hermetic seal. The fence 32 may extend outward from the shell and may at least partially surround the conductor pins 22. The fence 32 may include an opening 48 that engages the terminal body 24 to locate the fence 32 on the shell 12 and to locate the fence 32 with respect to the conductor pins 22. Locating the fence 32 with respect to the conductor pins 22 allows for a close fit between the plug assembly 18 and both the terminal 14 and the fence 32. The fence 32 may include a cavity 50 within which the conductor pins 22 may be located. Attachment between the fence 32 and the plug assembly 18 provides a seal that restricts or prevents moisture and/or debris from leaking therebetween and causing corrosion of the conductor pins 22.

The plug assembly 18 allows for the connection of the portion of the conductor pins 22 located outside of the shell 12 to a plurality of wires 55 that extend between the plug assembly 18 and the external supply of electrical power. The plug assembly 18 may include a molded-outer body 64 surrounding a molded-inner core 66. The outer body 64 and the inner core 66 may be formed from a thermoset or thermoplastic material, for example. The inner core 66 may include female-electrical receptacles 70 for receiving respective conductor pins 22. The plurality of receptacles 70 are equal in number to and arranged in the same pattern as the conductor pins 22 of terminal 14. The connection between the conductor pins 22 and the receptacles 70 provides for both an electrical connection between the conductor pins 22 and receptacles 70 as well as a mechanical connection that maintains the plug assembly 18 in a desired position relative to the terminal 14 and fence 32. The inner core 66 may position the wires 55 relative to the receptacles 70 to allow the wires to be in electrical communication with the conductor pins 22 when the conductor pins 22 are received within the receptacles 70.

The outer body 64 may include an end cap 78, a connector body 80, and a housing cover 81 that may surround the inner core 66. The end cap 78 may seat against a distal edge of the fence 32 when the plug assembly 18 is fully engaged with the terminal 14. The connector body 80 extends from the end cap 78 into the cavity 50 and may include an annular seal 100. The seal 100 may sealingly engage an inner diametrical surface of the fence 32 when the plug assembly 18 is fully engaged with the terminal 14. The receptacles 70 may extend through an axially facing surface of the connector body 80. The housing cover 81 may extend from the end cap 78 and the connector body 80 and may house a portion of the inner core 66 that positions the wires 55.

In some embodiments, the fit between the terminal 14 and the plug assembly 18 may be tight enough to retain the plug assembly 18 on the terminal 14. In some embodiments, the plug assembly 18 may include a plug retainer 118 that may be selectively attached to the fence 32 to restrict removal of the plug assembly 18 from the fence 32. The plug retainer 118 may include a generally U-shaped main body 120, a pair of arms 122, 124 extending from the main body 120, and a projection 126. The plug retainer 118 may be integrally formed from a thermoset or thermoplastic material, for example, or another polymeric material. The arms 122, 124 extend from opposite portions of the main body 120 and cooperate to secure the main body 120 to the fence 32. The arm 122 may include a first attachment feature 128 and the arm 124 may include a second attachment feature 130.

The first attachment feature 128 may include a ramped portion 132 that facilitates insertion of the plug retainer 118 into the fence 32. The first attachment feature 128 may also include an extension 134 that engages one of a plurality of slots 144 (FIG. 3) in the fence 32 to secure the plug retainer 118 relative to the fence 32. The second attachment feature 130 may include a ramped portion 136 that also facilitates insertion of the plug retainer 118 into the fence 32 and an extension 138 that engages another of the slots 144 in the fence 32 to further secure the position of the plug retainer 118 relative to the fence 32.

The projection 126 extends from the main body 120 generally between the arms 122, 124 and may include a tab 142 disposed at a distal end thereof. The tab 142 may engage the fence 32 when the plug retainer 118 is attached to the fence 32 to exert a force on the arms 122, 124 to securely attach the plug assembly 18 to the terminal 14.

In some embodiments, the plug retainer 118 may include a tether (not shown) that attaches the plug retainer 118 to the plug assembly 18. The tether may include a braided-metal cable that engages apertures in the plug assembly 18 and the plug retainer 118, respectively. The tether may include a length that allows the plug retainer 118 to be attached to and removed from the fence 32 while concurrently allowing the plug retainer 118 to be held in close proximity to the fence 32 when the plug retainer 118 is not attached to the fence 32.

The conduit adaptor 20 may engage the plug retainer 118 and/or the outer body 64 of the plug assembly 18 and may couple the conduit 21 to the plug assembly 18. The conduit adaptor 20 may include a cross-member 150, first and second arms 152, 154, and a conduit receptacle 156. The first and second arms 152, 154 may extend from and cooperate with the cross-member 150 to form a generally U-shaped, integrally formed body. The conduit adaptor 20 may be formed from a thermoset or thermoplastic material, such as a thirty-percent glass-fiber-reinforced polyethylene terephthalate, for example. The conduit adaptor 20 may be formed by an injection-molding process, for example, and/or any other suitable manufacturing processes. In some embodiments, the conduit adaptor 20 may be formed from Petra® 130FR, manufactured by BASF, or Rynite® FR530, manufactured by DuPont, for example. It will be appreciated that the conduit adaptor 20 could be formed from one or more other polymeric materials.

Figure 7:
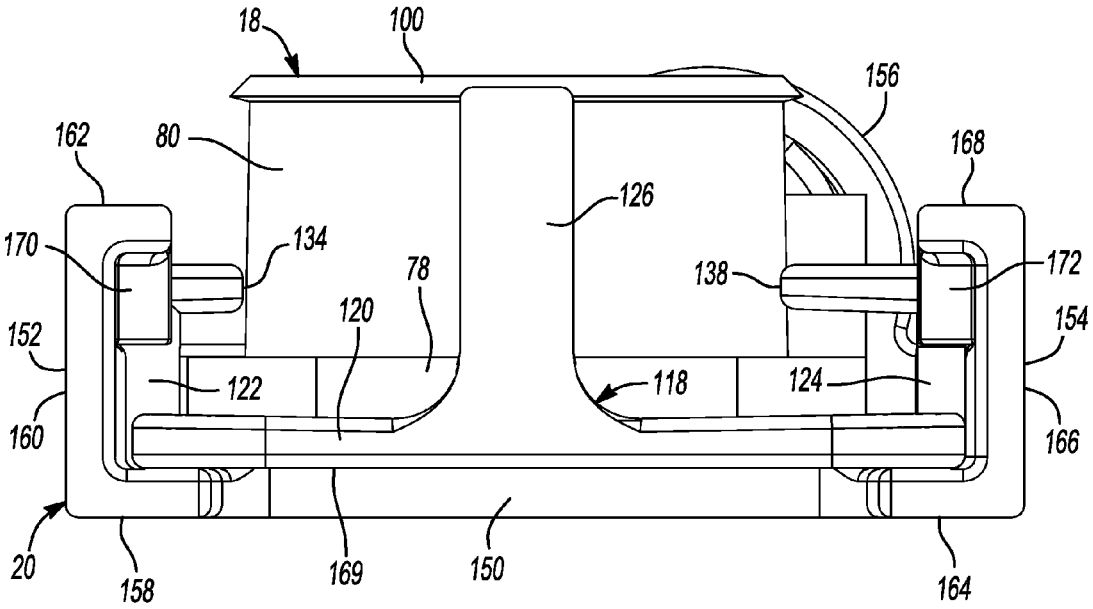
FIG. 7 is a top view of the plug assembly and the conduit adaptor.

The first arm 152 may include a first portion 158, a second portion 160, and a third portion 162. The first, second and third portions 158, 160, 162 may cooperate to form a generally U-shaped member that receives the arm 122 of the plug retainer 118. Similarly, the second arm 154 may include a first portion 164, a second portion 166, and a third portion 168. The first, second and third portions 164, 166, 168 may cooperate to form a generally U-shaped member that receives the arm 124 of the plug retainer 118. As shown in FIG. 7, an outward-facing surface 169 of the main body 120 of the plug retainer 118 may abut the first portions 158, 164.

Figure 6:
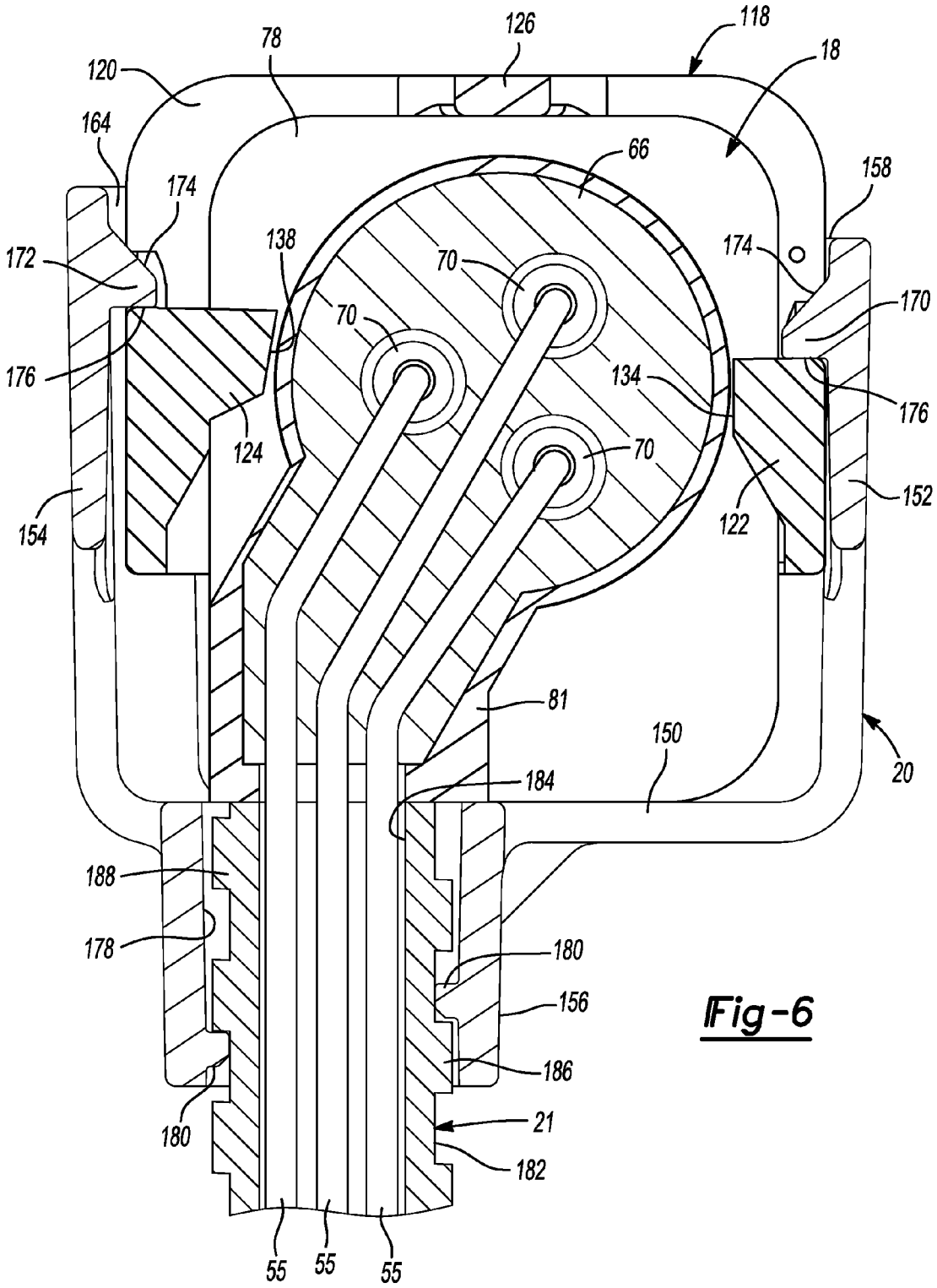
FIG. 6 is cross-sectional view of the plug assembly and the conduit adaptor.

The first and second arms 152, 154 may also include first and second tabs 170, 172, respectively, that may extend toward each other from the second portions 160, 166, respectively. Each of the first and second tabs 170, 172 may include a tapered surface 174 and an engagement surface 176 (FIG. 6). The engagement surfaces 176 of the first and second tabs 170, 172 may engage a respective one of the arms 122, 124 of the plug retainer 118. The first and second arms 152, 154 may be resiliently flexible to allow the plug retainer 118 to be inserted therebetween and snap into engagement with the first and second tabs 170, 172.

The conduit receptacle 156 may be a generally cylindrical member extending from the cross-member 150 in a direction opposite the first and second arms 152, 154. The conduit receptacle 156 may be positioned relative to the first and second arms 152, 154 such that when the plug assembly 18 is received between the first and second arms 152, 154, the conduit receptacle 156 may be substantially aligned with the plurality of wires 55. The conduit receptacle 156 may include an aperture 178 that extends therethrough. As shown in FIG. 6, the wires 55 may extend through the aperture 178 when the plug assembly 18 is received in the conduit adaptor 20.

The conduit receptacle 156 may include one or more helical protrusions or threads 180 that extend inward from a surface defining the aperture 178. While, in some embodiments, the protrusions 180 may extend around only a portion of the aperture 178, in other embodiments, the protrusions 180 may form a continuous thread extending three-hundred-sixty degrees (or more) around the aperture 178. In some embodiments, the protrusions 180 may include a set of threads extending through some or all of the axial length of the aperture 178. In some embodiments, the one or more protrusions 180 may include one or more helical or non-helical tabs, barbs or other engagement features configured to engage the conduit 21.

The conduit 21 may be a relatively flexible, hollow tube formed from a metallic and/or polymeric material, for example. The conduit 21 may include an outer surface 182 and an inner surface 184 defining a passageway that receives the wires 55. The outer surface 182 may include helical threads or ribs 186. An end 188 of the conduit 21 may be received in the aperture 178 of the conduit receptacle 156 such that the ribs 186 may engage the protrusions 180 (FIG. 6). In this manner, the conduit 21 may be secured to the plug assembly 18 via the conduit adaptor 20 without fasteners or clamps and may provide additional insulation and protection for the wires 55 to restrict or prevent damage to the wires 55. While not specifically shown in the figures, the conduit 21 may extend from the conduit adaptor 20 to the source of electrical power.

Figure 5:
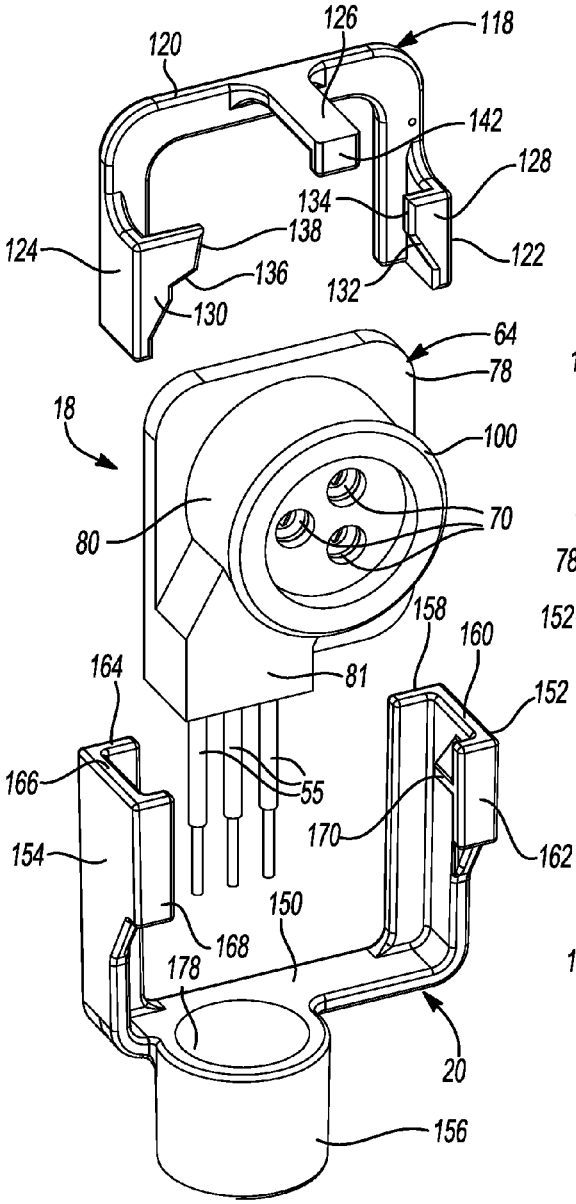
FIG. 5 is a cross-sectional view of the terminal, the plug assembly and the conduit adaptor.
Figure 5:
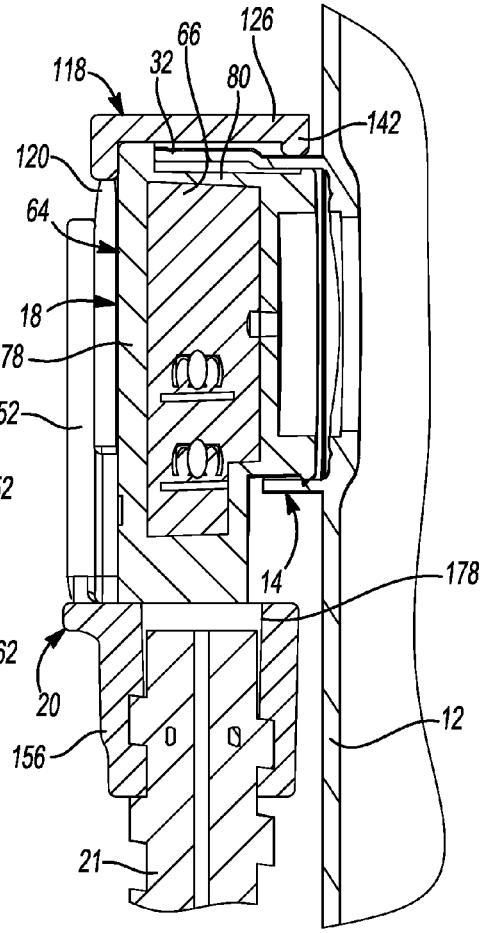
Figure 4:
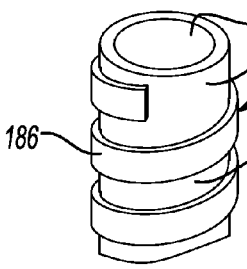
FIG. 4 is a partially exploded perspective view of the plug assembly and the conduit adaptor.

With continued reference to FIGS. 1-7, operation of the conduit adaptor 20 and plug retainer 118 will be described in detail. When the plug assembly 18 is attached to the terminal 14 such that the conductor pins 22 are respectively received within receptacles 70, the plug retainer 118 may be positioned relative to the plug assembly 18 to restrict removal of the plug assembly 18 from the terminal 14 and/or relative motion between the plug assembly 18 and the terminal 14. Specifically, the main body 120 of the plug retainer 118 may be generally slid over the outer body 64 of the plug assembly 18 until the extensions 134, 138, of attachment features 128, 130, respectively, are snapped into engagement with the slots 144 (FIG. 3) of the fence 32 and the tab 142 of the projection 126 engages an outer surface of the fence 32 (FIG. 5).

The wires 55 extending from the plug assembly 18 may be inserted through the aperture 178 of the conduit receptacle 156 and into the conduit 21. The conduit 21 may be twisted relative to the conduit adaptor 20 to threadably engage the ribs 186 with the protrusions 180 of the conduit receptacle 156. In some embodiments, the end 188 of the conduit 21 may be pushed straight (i.e., without twisting) into the aperture 178 of the conduit receptacle 156 and snapped or pressed into engagement with the protrusions 180. In some embodiments, an adhesive may be applied to the conduit receptacle 156 and the conduit 21 to bond the conduit 21 in place within the aperture 178.

With the plug retainer 118 securing the plug assembly 18 relative to the fence 32, the conduit adaptor 20 may be slid onto the plug retainer 118 such that the arms 122, 124 of the plug retainer 118 and the end cap 78 of the plug assembly 18 are at least partially received between the first and second arms 152, 154 of the conduit adaptor 20. As the conduit adaptor 20 is slid upward (relative to the views shown in FIGS. 1 and 2-6) into engagement with the plug retainer 118, the tapered surfaces 174 of the tabs 170, 172 may slide against the arms 122, 124 of the plug retainer 118, which may force the first and second arms 152, 154 of the conduit adaptor 20 to flex outward away from each other. As the conduit adaptor 20 continues to slide onto the plug retainer 118, the arms 122, 124 will snap into engagement with engagement surfaces 176 of the respective tabs 170, 172 of the conduit adaptor 20, as shown in FIG. 6.

As described above, the conduit 21 may be attached to the conduit adaptor 20, and the conduit adaptor 20 may be attached to the plug retainer 118, which may be secured to the fence 32. In this manner, little or no weight or load of the conduit adaptor 20 and conduit 21 may be transmitted to the plug assembly 18. Instead, the load of the conduit adaptor 20 and conduit 21 may be supported by the plug retainer 118 and the fence 32. Because little or no load may be transmitted to or supported by the plug assembly 18, very little or no load may be transmitted to the conductor pins 22 of the terminal 14, and therefore, bending and/or other damage to the conductor pins 22 and/or other components of the terminal 14 may be substantially avoided. This may increase the operational life of the terminal 14 and improve the reliability of the terminal 14 and the electrical device receiving electrical power through the terminal 14.

It will be appreciated that the terminal 14, plug assembly 18, and plug retainer 118 described above and shown in the figures are exemplary and are provided for purposes of illustration. The conduit adaptor 20 can be configured to be attached to any other configuration or type of plug assembly and/or plug retainer. In some embodiments, the conduit adaptor 20 could be integrally formed with the plug assembly 18 and/or the plug retainer 118. In some embodiments, the conduit adaptor 20 may be attached directly to the plug assembly 18 and/or directly to the fence 32.

In some embodiments, the conduit receptacle 156 could be a separate body that is attached to the cross-member 150 by threaded engagement or a snap-fit, for example. In other embodiments, the conduit receptacle 156 could be integrally formed with or attached directly to the plug assembly 18.

While the plug assembly 18, plug retainer 118, conduit adaptor 20, and conduit 21 are described above as being used with a compressor, a fan, a heater and/or a sensor, in some embodiments, the conduit adaptor 20 could be used to connect the conduit 21 to any plug assembly and/or plug retainer for any electrically powered component.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An electrical assembly comprising:

a plug body encasing a plurality of electrical receptacles and first ends of a plurality of wires electrically connected to said electrical receptacles;

an adaptor coupled to the plug body and including a conduit receptacle having an aperture, said adaptor including a cross-member and first and second arms extending from said cross-member, said plug body received between said first and second arms;

a conduit engaging said aperture to allow said plurality of wires to extend through said aperture and through said conduit; and a plug retainer engaging said plug body and including a plurality of tabs configured to engage a fence at least partially surrounding an electrical terminal of a compressor.

2. The electrical assembly of claim 1, wherein said electrical receptacles in said plug body receive a respective one of a plurality of conductor pins extending from an electrical terminal to provide electrical communication between said plurality of wires and said plurality of conductor pins.

3. The electrical assembly of claim 1, wherein said conduit receptacle includes a protrusion extending radially inward from a surface defining said aperture.

4. The electrical assembly of claim 3, wherein said protrusion engages a helical surface of said conduit.

5. The electrical assembly of claim 1, wherein said conduit receptacle extends from said cross-member in a direction opposite said first and second arms.

6. The electrical assembly of claim 1, wherein said first and second arms include first and second tabs, respectively, that engage said plug retainer.

7. The electrical assembly of claim 6, wherein said plug retainer includes first and second members receiving said plug body therebetween, said first and second members being received between said first and second arms of said adaptor.

8. A compressor comprising the electrical assembly of claim 1, the electrical assembly being connected to a terminal extending through a shell of the compressor.

9. A compressor comprising:

a shell including an opening;

an electrical terminal engaging said opening and including a plurality of first electrically conductive members and a fence at least partially surrounding the plurality of first electrically conductive members;

a plug including a plurality of second electrically conductive members in electrical communication with said first electrically conductive members;

a plurality of wires extending from said second electrically conductive members;

a plug retainer including a body portion and first, second and third members extending outwardly from the body portion and engaging said fence, said first and second members receiving a portion of said plug;

an adaptor including a cross-member, first and second arms extending outwardly from the cross-member in a first direction, and a conduit receptacle extending from the cross-member in a second direction, said plug being disposed between said first and second arms, said first and second members of said plug retainer engaging said first and second arms;

a conduit engaging said conduit receptacle and receiving said plurality of wires.

10. The compressor of claim 9, wherein said conduit receptacle includes an aperture and a protrusion extending into said aperture and engaging an outer surface of said conduit.

11. The compressor of claim 9, wherein said first and second arms include first and second tabs, respectively, that extend toward each other and engage said first and second members, respectively.

12. The compressor of claim 11, wherein said first and second arms are resiliently flexible to allow said first and second members to snap into engagement with said first and second tabs.

13. The compressor of claim 9, wherein said first and second members are disposed between said first and second arms.

14. The compressor of claim 9, wherein said plug retainer supports a majority of a weight of said adaptor and said conduit.

* * * * *

UNITED STATES PATENT AND TRADEMARK OFFICE

CERTIFICATE OF CORRECTION

PATENT NO. : 8,721,371 B2
APPLICATION NO. : 13/478235
DATED : May 13, 2014
INVENTOR(S) : Benjamin Paul Picker et al.

It is certified that error appears in the above-identified patent and that said Letters Patent is hereby corrected as shown below:

In the Specification

| | |
|---|---|
| Column 8, Line 24 | Delete “tabs” and insert --first and second tabs--. |
| Column 8, Line 30 | Delete “tabs” and insert --first and second tabs--. |

In the Claims

| | |
|---|---|
| Column 10, Line 27 | In Claim 9, after “arms;”, insert --and--. |

Signed and Sealed this
Eleventh Day of August, 2015

Michelle K. Lee

Michelle K. Lee
*Director of the United States Patent and Trademark Office*